US006050343A

United States Patent [19]

Garcia Calvo

[11] Patent Number: 6,050,343

[45] Date of Patent: Apr. 18, 2000

[54] FIRE FIGHTING SYSTEM FOR LARGE CONTAINER WITH FLAMMABLE PRODUCTS

[76] Inventor: Benigno Garcia Calvo, Avenida San Froilan, 99, 24005 Leon, Spain

[21] Appl. No.: 09/088,691

[22] Filed: Jun. 1, 1998

[30] Foreign Application Priority Data

May 30, 1997 [ES] Spain ..... 9701188

[51] Int. Cl.[7] ..... A62C 3/07

[52] U.S. Cl. ..... 169/68; 169/36

[58] Field of Search ..... 169/66, 68, 36

[56] References Cited

U.S. PATENT DOCUMENTS

| | | | |
|---|---|---|---|
| 2,515,832 | 7/1950 | Mournaud | 169/36 |
| 2,757,744 | 8/1956 | Malone | 169/66 X |
| 2,917,116 | 12/1959 | Wyant | 169/36 X |
| 3,120,273 | 2/1964 | Kaufman et al. | 169/66 X |
| 3,833,063 | 9/1974 | Williams | 169/36 X |

FOREIGN PATENT DOCUMENTS

| | | | |
|---|---|---|---|
| 274309 | 7/1988 | European Pat. Off. | 169/66 |
| 9700590 | 3/1997 | Spain . | |
| 2275189 | 8/1984 | United Kingdom | 169/36 |

*Primary Examiner*—Kevin Weldon

*Attorney, Agent, or Firm*—Ostrolenk, Faber, Gerb & Soffen, LLP

[57] ABSTRACT

A system for extinguishing a fire in a tank filled with a flammable liquid product: a receptacle having an explosive charge within it and an extinguisher product that is dispersable over the flammable product to extinguish a fire there. Fuses that are ignited by contact with the fire communicate from outside the receptacle into the explosive charge. A flotation device below the receptacle, e.g. a lower bowl or a shell or flotation elements. The receptacle has an upper closing cover. The receptacle may be held beneath the surface of the flammable product by a weight to which the receptacle is moored by a rope that extends above the flammable product. The rope is separated by a fire of the flammable product, freeing the receptacle to float to the surface where the fuse to the explosive charge is ignited.

10 Claims, 5 Drawing Sheets

FIRE FIGHTING SYSTEM FOR LARGE CONTAINER WITH FLAMMABLE PRODUCTS

BACKGROUND OF THE INVENTION

The present invention refers to a system to control and extinguish fires in large size tanks that store flammable products, such as hydrocarbons.

The system is based on the tank containing the flammable product also containing either a floating or a submerged extinguisher device that is activated at the moment when a fire breaks out in the tank.

The system is particularly applicable to refineries and all types of hydrocarbons plants having tanks of up to 70 m diameter containing flammable products, and is intended to extinguish a fire that occurs in the tanks themselves or in spills that sometimes occur in refineries and hydrocarbon plants.

As is known, refineries and hydrocarbon plants have small, medium and large capacity tanks that contain flammable products that are difficult or practically impossible to extinguish when a fire occurs.

Obviously, although numerous systems exist to extinguish fires, in all cases they are intended to be applied to large fires where people are involved who are obliged to distribute the fire-retardant product, either in the form of powder, gas or liquid, over dangerous areas.

Taking account of this, the inventor herein attempted to solve the problem of extinguishing forest fires and obtained patents disclosing a device for fire extinguishing, including Spanish Patent No. P-9700590, which describes a device to extinguish fires from a distance. That patent discloses a large container holding the fire-extinguisher product in the form of powder, gas or liquid, and immersed in the container is an extinguisher intended to explode on contact with the fire when heat is detected. This frees the extinguisher product contained in the extinguisher, and simultaneously extends the product contained in the external container.

Furthermore, the device can be activated directly or at a distance, or by detection of the heat caused by a fire.

The device in Spanish Patent No. P-9700590 is intended for extinguishing large fires, but is not intended to put out fires that originate in large tanks containing flammable products, such as those found in hydrocarbons refineries and similar.

SUMMARY OF THE INVENTION

The system of the invention is based on the device to extinguish fires from a distance disclosed in Spanish Patent No. P-9700590, but make this device applicable to extinguishing fires that break out in containers or tanks of flammable products.

The system of the invention, based on a device to extinguish fires of the type mentioned, may include a receptacle that can contain a fire-extinguishing agent or extinguisher. Within that container is a compartment or receptacle with another extinguisher agent, preferably powder, together with an explosive charge and together with fuses. Igniting the fuses causes explosion of the explosive charge, which in turn causes explosion of the extinguisher or fire-retardant product in the inside compartment, and this immediately causes explosion of the external receptacle which spreads the fire fighting product contained in the receptacle.

Obviously this device to extinguish fires can be constituted in a different form with regard to the explosive charges inside it.

Taking the above into account, the fire extinguishing device, whatever its assembly of elements for causing explosion of its contents and spreading thereof in the tank, within the type referred to above, has flotation means to keep the whole device on the surface of a flammable liquid contained in a tank in which the system is applied. The flotation means may comprise a body that is bowl-shaped or is semi-spherical and which is closed on its upper part by another piece which is of the same size and which may be transparent. Together they form a receptacle in which the extinguisher device, according to the mentioned characteristics, is seated. The corresponding fuses emerge to the outside of the receptacle. The flotation means enable the whole device to float on the surface of flammable liquid contained in the large tank or the device can even be submerged below the surface of the liquid in the large tank and the device can be anchored in this position by appropriate means. Those means include counterweights located on the bottom of the tank, which have a tackle or ring on their upper part, through which is passed an appropriate mooring element, or a cable or rope, having one end which holds the extinguisher device, while the other end stretches upwards above the liquid, e.g. to the edge of the tank. At the moment when a fire occurs, the upper attachment of the mooring element is burned, which frees the extinguisher device which floats to the surface, exposing the fuses to fire and immediately causing an explosion of the extinguishing device and therefore the extinguishment of the fire.

Obviously the means of flotation can be formed in any manner, for example by a base formed by a flat lower body on which the extinguisher device rests, with a container receptacle with a different configuration that forms a more stable support based on the float itself, and complementing this with some lateral floats to achieve the stability of the whole, and even the protection of the extinguisher device.

Logically, if the device is submerged in the flammable liquid inside the tank, the device must have means of hermetical sealing so that the flammable liquid does not enter it.

Also, it should be noted that the overall extinguishing device with the float can be placed inside a tank by any conventional system such as by helicopter, crane or similar, or onto the upper surface of the tank containing the flammable liquid, when the fire starts in it.

BRIEF DESCRIPTION OF THE DRAWINGS

To assist in a better understanding of the characteristics of the invention, drawings are attached from which the features and advantages of the object of the invention may be more easily understood.

DESCRIPTION OF THE PREFERRED EMBODIMENTS

Figure 1:
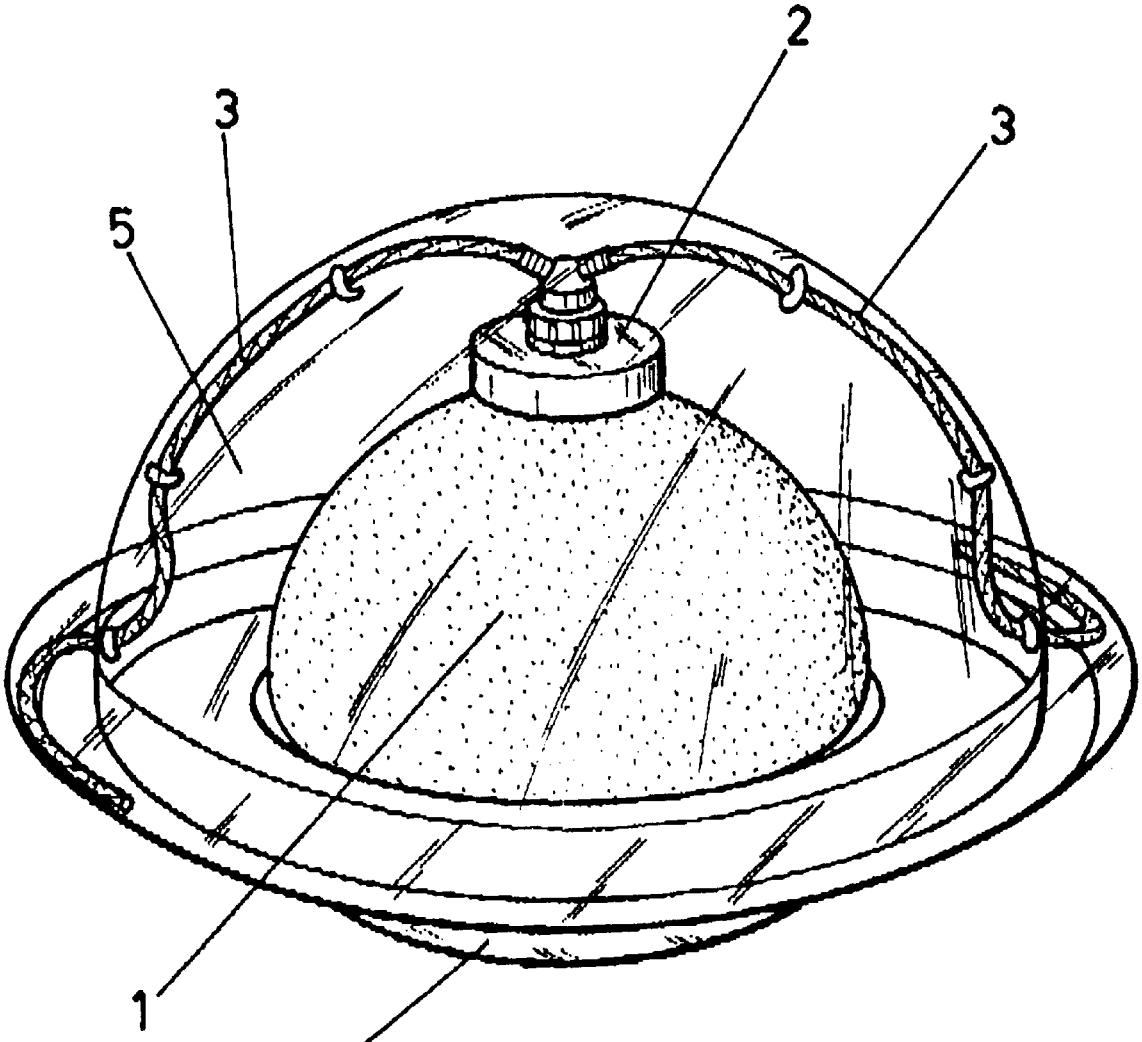
FIG. 1 shows a perspective view of one embodiment of a fire extinguisher device with the external body as the container element and serving as a float for the whole.

In FIG. 1, the extinguisher system or unit of the invention includes an extinguisher device 1 with an upper part that includes a cover 2 through which some fuses 3 exit for starting ignition of an explosive charge. Burning of the fuses 3 activates the explosive charge contained in the body of the extinguisher 1 itself.

However, whatever may be the shape, configuration and explosive charge contained in the extinguisher 1, it is placed inside a flotation body made from a shell or bowl that forms a lower receptacle 4 in which the container or extinguisher 1 itself is perfectly positioned. The shell or bowl 4 is finished with a closing top cover 5 which is transparent. In FIG. 1 the cover 5 has a practically semi-spherical configuration that fits on the body forming the lower support shell 4, and there is an hermetical seal between both parts to keep the extinguisher 1 perfectly sealed.

The flotation group formed by the lower support body 4 and the upper transparent shell or cover 5 form an extinguishing medium with appropriate characteristics so that it can float on the flammable liquid contained in a large tank, as described below, or may be submerged inside the flammable liquid. The explosive charge is activated in either case at the moment when a fire occurs, so that the explosive charge expands in the corresponding explosion and the fire is put out.

As seen in FIG. 1, the fuses 3 are appropriately guided inside the transparent upper closure cover 5. Their ends have correct means to start ignition, either by the heat produced by the fire or by direct contact with the flame.

Figure 2:
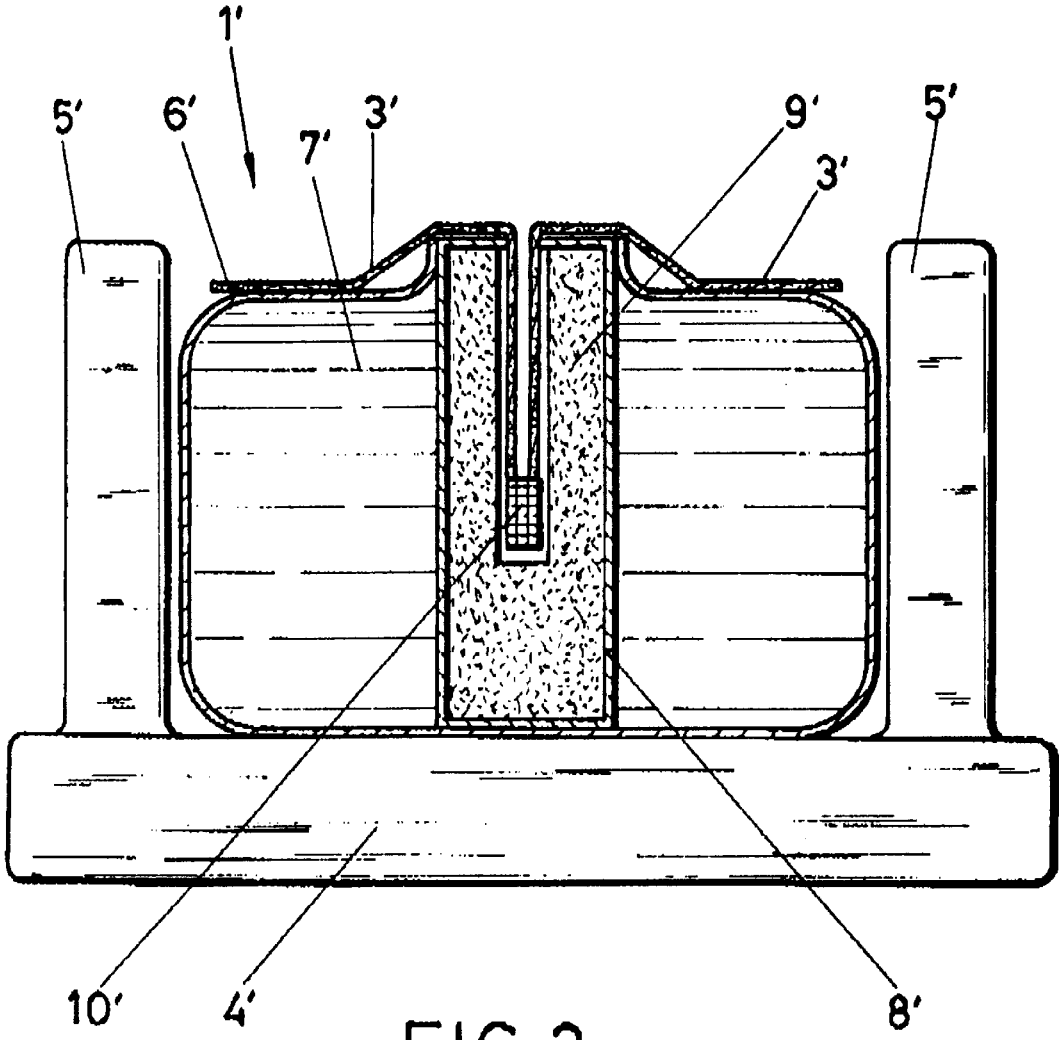
FIG. 2 shows a schematic side view, with a section view of the extinguisher device, and the means of flotation of a different embodiment.

In another form shown in FIG. 2, the extinguisher 1' as a whole includes a receptacle 6' that contains the fire extinguishing product 7'. A second receptacle 8 placed in the receptacle or tank 6' contains another extinguisher product 9'. The corresponding fuses 3 emerge from inside the receptacle 8 to ignite the explosive charge 10' which will in the first place activate the extinguisher product 9' and then activate the extinguishing product 7', following the corresponding explosions, causing these extinguisher products to be scattered.

In this construction, the extinguisher unit is mounted or placed on flotation means formed by a flat base 4' on which the receptacle 6' is supported and held. The flat base 4' has lateral wall 5' to hold and protect the receptacle 6' that forms the extinguisher 1' itself.

Figure 3:
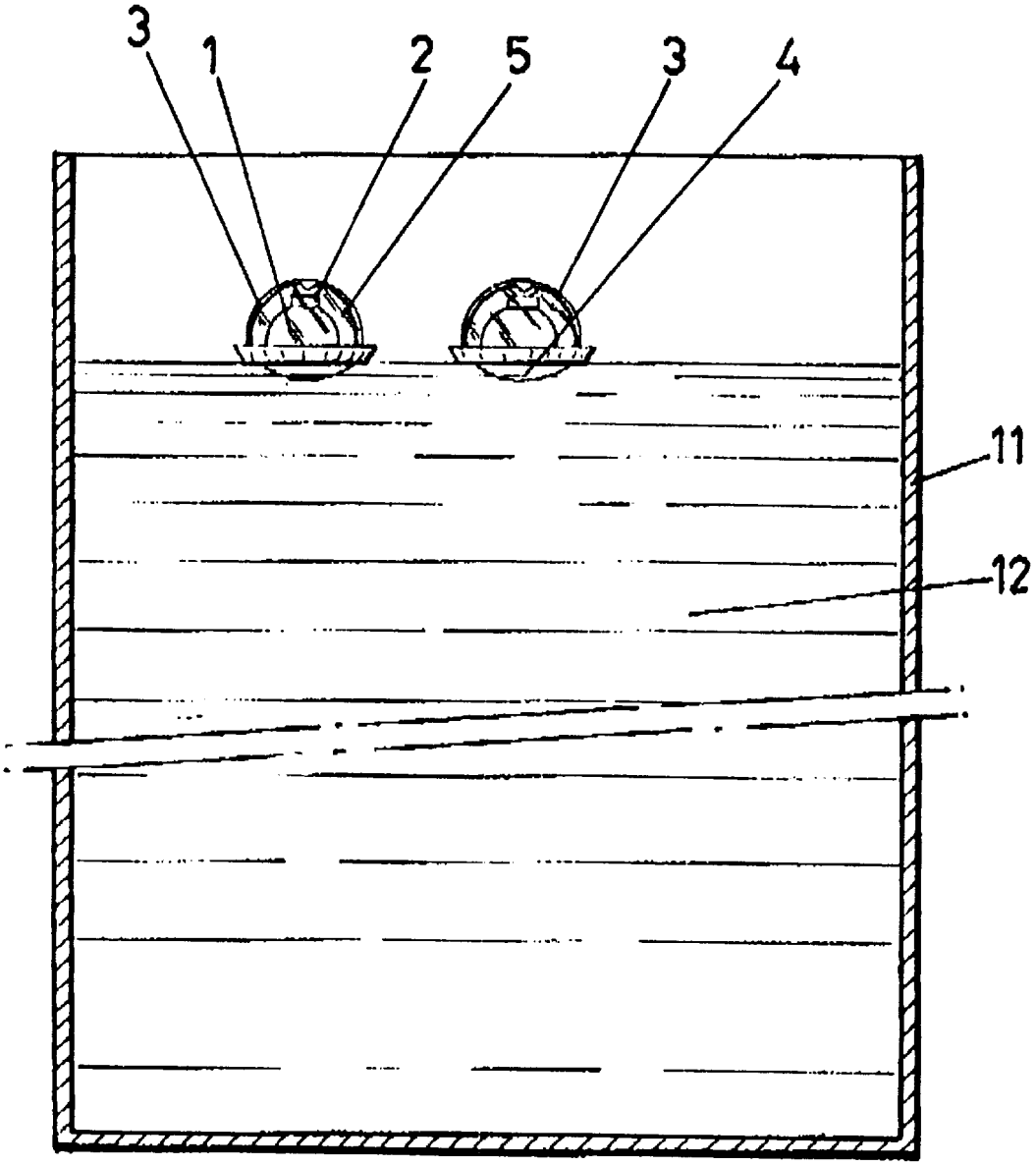
FIG. 3 shows a practical application of the system of the invention in a large tank containing a flammable liquid and two extinguisher units, as shown in FIG. 1, floating on it.

FIG. 3 shows one practical application of the system on a large sized tank 11, containing a flammable product 12. It shows two extinguisher units, as shown in FIG. 1, floating on the flammable liquid 12, so that if the liquid catches fire, the fuses 3 will be ignited and immediately thereafter the explosive charge will explode, scattering the extinguisher product and extinguishing the fire.

Figure 4:
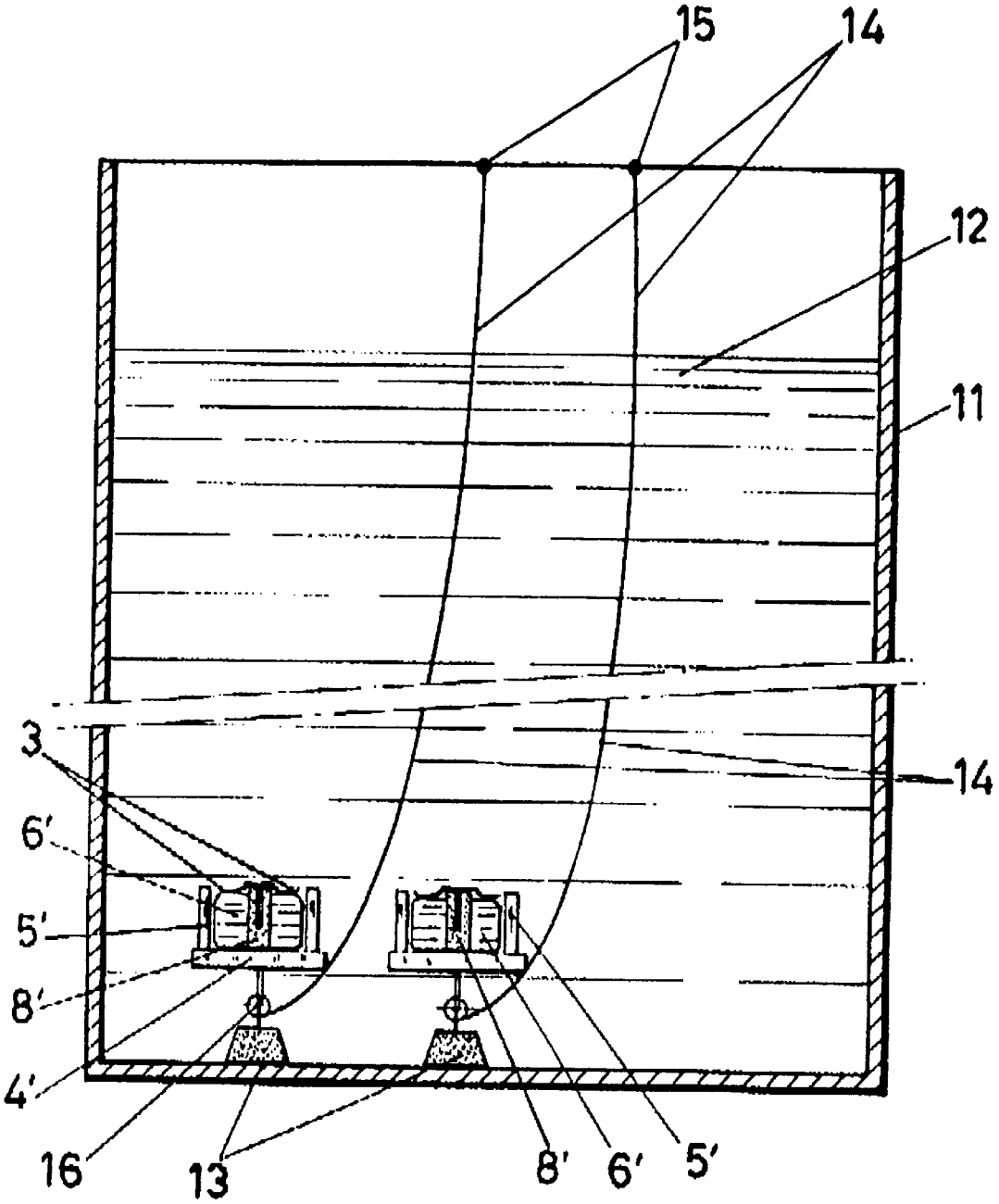
FIG. 4 shows another practical application of the same system, but in this case the two extinguisher units are the same as shown in FIG. 2 and are shown submerged.

FIG. 4 shows the application of the device or extinguisher represented in the FIG. 2, submerged in the flammable liquid 12 contained in the corresponding large sized tank 11. The two extinguisher units or groups are kept submerged by respective counterweights 13 located on the bottom of the tank 11. Each unit or group is held by a mooring element, such as a cable, rope or similar element 14, that has an upper end that is moored to an anchoring point 15 on the upper part of the tank 11, while the mooring element 14 is passed through a tackle, hoop, or similar element 16 on the counterweight 13, and then extends up to the extinguisher, causing the cable 14 to hold the extinguisher device or group.

Under the circumstances, if a fire occurs at the surface of the flammable product or liquid 12 contained in the tank 11, first the upper end of the mooring element 14 will burn free from its securement at point 15 and therefore leave the extinguisher unit or group itself free. Its flotation system 4'–5' will cause the extinguisher to immediately reach the surface or the level of the flammable product or liquid 12, floating and then causing the spreading of the extinguisher product, because the fuses 3' have been activated by the fire itself.

Figure 5:
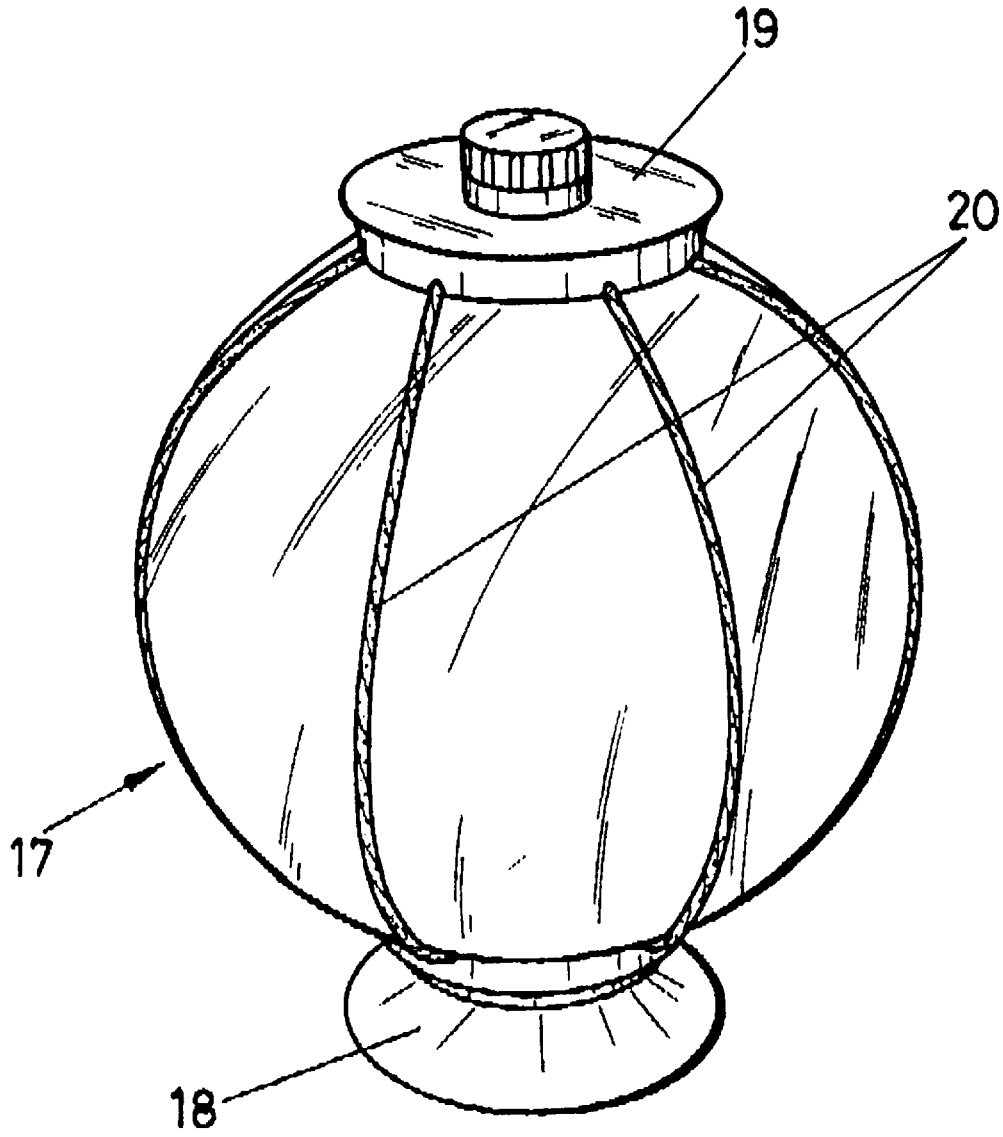
FIG. 5 shows a general view in perspective of yet another form of the extinguisher, which allows it to fall on a tank containing flammable liquid that is burning.

FIG. 5 shows another extinguisher group or unit which has a balloon-like shape 17 with a lower foot or base 18 and an upper cover 19. Inside the transparent cover that forms the balloon 17 there are corresponding fuses 20, all forming a group. This assembly can be deposited from a helicopter, letting it fall on the flammable liquid contained in a large size tank, once a fire has started, so that the fuses 20 are ignited and then activate the explosive charge producing a corresponding explosion, spreading the extinguisher product contained inside the shape 17.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A fire fighting system for use in a container for a liquid flammable product for extinguishing a fire on the surface of the flammable product in the container, wherein the system comprises:

an extinguisher device comprising a receptacle containing a product which extinguishes a fire when spread over the flammable product in the container, the extinguisher device being submersible in the flammable product in the container;

an explosive charge in the receptacle;

an ignition fuse communicating with the explosive charge in the receptacle, the fuse extending out of the receptacle; and a flotation device connected with the receptacle and placed and shaped to maintain the stability of the receptacle while floating on the surface of the flammable product in the container, whereby upon ignition of the fuse, the explosive charge may be exploded by the fuse to dispense the extinguisher product over the flammable product within the container;

a holding device in the container for holding the receptacle below the surface of the flammable product; and a separable mooring element mooring the receptacle to the holding device below the surface of the flammable product, the mooring element extending above the surface of the flammable product in the container and being alterable by fire on the surface of the flammable product for releasing the moored receptacle from below the surface of the flammable product, such that the flotation device causes the receptacle to float above the surface of the flammable product where the fuse may be ignited to ignite the explosive charge.

2. The system of claim 1, wherein the flotation device comprises a bowl disposed beneath the receptacle, the receptacle being supported above the bowl and the fuses passing through the receptacle.

3. The system of claim 2, wherein the fuse extends from outside the receptacle into the receptacle and is supported in the flotation device.

4. The system of claim 3, wherein the flotation device is a semi-spherical bowl located below the receptacle, the receptacle is a semi-spherical part above the flotation device and the flotation device and the receptacle together define a spherical enclosure for the extinguisher product and the explosive charge.

5. The system of claim 2, wherein the flotation device comprises a bottom base and lateral float elements attached to the base to keep the base and receptacle floating in a stable manner on the flammable product.

6. The system of claim 1, holding device for holding the receptacle below the surface of the flammable product comprises a weight in the tank and the mooring element moors the receptacle to the weight for holding the receptacle beneath the surface of the flammable product.

7. The system of claim 1, wherein the mooring element extends from above the surface of the flammable product into the flammable product to the holding device and then to the receptacle for holding the receptacle beneath the surface of the flammable product.

8. The system of claim 7, wherein the mooring element includes a rope that extends from above the surface of the flammable product to the holding device below the surface to the receptacle, the rope being flammable to be burned to release the receptacle;

an anchoring element above the surface of the flammable product to which the mooring rope is anchored for the mooring rope to restrain the receptacle from floating up in the flammable product.

9. The system of claim 1, wherein the extinguisher device receptacle includes:

a first receptacle for containing a first extinguisher product;

a second receptacle within the first receptacle for containing a second extinguisher product in the form of a powder and an explosive charge, and the fuse extends from outside the first receptacle into the explosive charge in the second receptacle.

10. The system of claim 9, wherein the fuse is held at its free end in the upper part of the receptacle, and when the fuse is ignited, it ignites the explosive charge for scattering the extinguisher product.

* * * * *